US011111112B2

(12) United States Patent
Jackson et al.

(10) Patent No.: US 11,111,112 B2
(45) Date of Patent: Sep. 7, 2021

(54) LIFTING ASSEMBLY AND METHOD

(71) Applicant: BALLTEC LIMITED, Morecambe (GB)

(72) Inventors: Jonathan Jackson, Poulton-le-Fylde (GB); Marco Teixeira, Lancaster (GB)

(73) Assignee: BALLTEC LIMITED, Morecambe (GB)

( * ) Notice: Subject to any disclaimer, the term of this patent is extended or adjusted under 35 U.S.C. 154(b) by 223 days.

(21) Appl. No.: 16/333,890

(22) PCT Filed: Sep. 15, 2017

(86) PCT No.: PCT/GB2017/052742

§ 371 (c)(1),
(2) Date: Mar. 15, 2019

(87) PCT Pub. No.: WO2018/051117

PCT Pub. Date: Mar. 22, 2018

(65) Prior Publication Data

US 2019/0202670 A1 Jul. 4, 2019

(30) Foreign Application Priority Data

Sep. 15, 2016 (GB) ..... 1615733

(51) Int. Cl.
*B66C 1/66* (2006.01)

(52) U.S. Cl.
CPC ..... *B66C 1/66* (2013.01)

(58) Field of Classification Search
CPC ..... B66C 1/66; B66C 1/54; B66C 13/40
(Continued)

(56) References Cited

U.S. PATENT DOCUMENTS 2,179,594 A * 11/1939 Johnson ..... E21B 31/20 294/86.22
3,319,978 A * 5/1967 Melhose ..... F42B 15/36 285/18

(Continued)

FOREIGN PATENT DOCUMENTS

CN 104261242 A 1/2015
GB 1358282 7/1974

(Continued)

OTHER PUBLICATIONS

Patent Cooperation Treaty: International Search Report and Written Opinion for PCT/GB2017/052742 dated Jan. 8, 2018; 10 pages.

*Primary Examiner* — Paul T Chin
(74) *Attorney, Agent, or Firm* — Schwabe Williamson & Wyatt, PC

(57) ABSTRACT

A lifting assembly (10) having a structure (11) with three or more receptacles and a two or more connectors (1). The structure comprises one or more receptacles (12). Each receptacle comprises one or more circumferential grooves (17) in its inside surface. The connector comprises a male element (4) for insertion into a receptacle, an attachment point (2), and one or more locking elements (6) provided on the outside surface of the male element for engaging with the or each groove in the inside surface of the or each receptacle so as to rotatably mount the attachment point relative to the structure. The connectors may be rotationally positioned within the receptacles to permit different lifting configurations to be used.

20 Claims, 7 Drawing Sheets

(58) Field of Classification Search
USPC ..... 294/215, 94, 89, 82.28, 95
See application file for complete search history.

(56) References Cited

U.S. PATENT DOCUMENTS 3,680,906 A * 8/1972 Neumeier ..... B66C 1/66 294/89
4,204,711 A * 5/1980 Lancelot, III ..... B66C 1/666 294/82.28
4,573,725 A * 3/1986 Griffiths ..... B66C 1/66 24/603
4,863,205 A 9/1989 Schron
5,967,477 A * 10/1999 Walmsley ..... E21B 19/06 248/230.2
6,513,751 B2 * 2/2003 Michel ..... B65H 75/243 242/571.1
7,744,140 B2 * 6/2010 Rowley ..... F16B 7/025 294/94
9,163,651 B2 * 10/2015 Ostrobrod ..... F16B 13/0891
2003/0173792 A1 * 9/2003 Steinhovden ..... B66C 1/66 294/95
2008/0007056 A1 * 1/2008 Beesley ..... E21B 43/0107 285/321
2016/0052752 A1 * 2/2016 Walmsley ..... F16L 1/20 403/373
2019/0309824 A1 * 10/2019 Jackson ..... B63B 21/04

FOREIGN PATENT DOCUMENTS

GB 2457937 A 9/2009
JP S52115060 A 9/1977
KR 20150111415 A 10/2015
WO 01/87761 A1 11/2001
WO 2006/109065 A1 10/2006
WO 2018/051117 A1 3/2018

* cited by examiner

LIFTING ASSEMBLY AND METHOD

CROSS-REFERENCE TO RELATED APPLICATION

The present application is a national phase entry under 35 U.S.C. § 371 of International Application No. PCT/GB2017/052742, filed Sep. 15, 2017, which designates the United States of America, which claims priority to GB Application No. 1615733.1, filed Sep. 15, 2016, the entire disclosures of each of these applications are hereby incorporated by reference in their entireties and for all purposes.

TECHNICAL FIELD OF THE INVENTION

The present invention relates to a lifting assembly comprising a structure with three or more receptacles for receiving a connector provided with an attachment point and to a method of lifting using such an assembly.

BACKGROUND TO THE INVENTION

Structures such as lifting frames or cages and subsea modules are conventionally provided with a plurality of attachment points to which lifting lines or cables are connected in order to lift or lower the structure using a crane or a hoist. A pad eye is an attachment point that comprises a flat base connected to a U-shaped or circular loop that forms an aperture to which a part such as a hook, a shackle or a D-ring may be connected. The part connected to the padeye may then be attached to a lifting line.

Each padeye has a fixed orientation relative to the structure so that, in use, it remains in alignment with the connected lifting line when the structure is lifted and is thus not subject to an adverse bending moment, which could damage the pad eye and cause it to fail.

Depending upon the load to be carried by the structure and the position of the load on the structure, it may be desirable to connect lifting lines to different parts of the structure and/or to use multiple lifting points and/or different lifting configurations to ensure that the centre of mass of the load is under the lifting point(s).

However, this is not possible with conventional structures as they are provided with a single set of fixed pad eyes. As such, if, for example, the position of a load carried by the structure is altered then the padeyes may be subjected to an adverse bending moment during a lifting or lowering operation. Consequently some existing structures are deliberately over-engineered to account for this, leading to an increase in both cost and mass.

In addition, connection and disconnection of a lifting line to and from a padeye or attachment point is difficult in harsh conditions, such as those in offshore environments, and may therefore require significant ROV or diver intervention, which increases costs and downtime.

Embodiments of the present invention seek to address the above problems.

SUMMARY OF THE INVENTION

According to a first aspect of the present invention, there is provided a lifting assembly comprising:

a structure connected to, or forming part of, or for lifting apparatus deployed, or intended to be deployed, in a subsea location, the structure comprising three or more receptacles, each receptacle comprising one or more circumferential grooves in its inside surface; and at least two connectors, each connector comprising a male element for insertion into a receptacle of the structure, an attachment point for coupling to a lifting line, and one or more locking elements provided on the outside surface of the male element, wherein the one or more locking elements are engageable with the or each groove in the inside surface of a receptacle to enable the male element to be mounted in the receptacle at any desired rotational position relative to the receptacle and thereby mount the attachment point to the structure.

In this way, the present invention provides for an assembly comprising a structure having an attachment point the rotational orientation of which relative to the structure can be altered. In embodiments the attachment point may be rotationally mounted to the structure.

This allows the same attachment point to be used in a variety of different lifting configurations since the attachment point can be rotated to an angle relative to the structure and/or the lifting point where it provides its maximum lifting strength and is not subject to an adverse bending moment during a lifting or lowering operation. Accordingly, the assembly has improved functionality compared to conventional assemblies in which the attachment point has a fixed orientation, as described above. In addition, the present invention provides a quick and easy means of mounting a lifting line to a structure since the lifting line can be pre-attached to the attachment point on the connector before the connector is mounted to the receptacle. This is particularly important in harsh conditions such as offshore environments where significant ROV or diver intervention to disconnect and reconnect lifting lines directly to a padeye or an attachment point is difficult and therefore time consuming and expensive. Moreover, the present invention provides an improved safety factor since the above described safety issues with not using an attachment point in its maximum strength orientation are mitigated.

The one or more locking elements may be engageable with a groove in the inside surface of the receptacle so as to removably mount the attachment point to the structure.

The structure may comprise at least 4, 5, 6, 7 or 8 receptacles. Some or all of the receptacles may be provided in an arrangement such as a square arrangement, a rectangular arrangement or a triangular arrangement.

The or each receptacle may comprise a plurality of grooves in its inside surface. The grooves may be spaced from one another. For example, the grooves may be spaced substantially equidistant from one another with respect to a longitudinal axis of the receptacle.

Each receptacle may be substantially cylindrical. Alternatively, each receptacle may be substantially cuboidal. Each receptacle may have a substantially circular cross section. Alternatively, each receptacle may have a substantially square or substantially rectangular cross section.

Each of the one or more grooves in the inside surface of each receptacle may extend around at least part of the inside circumference or inside perimeter of the receptacle. Each of the one or more grooves in the inside surface of each receptacle may extend around the whole of the inside circumference or inside perimeter of the receptacle.

The lifting assembly may comprise at least 3, 4, 5, 6, 7 or 8 connectors.

The male element may be substantially cylindrical. The male element may be elongate. The male element may comprise a frustoconical free end.

The male element may comprise an aperture, one or more apertures or a plurality of apertures. Each aperture may be a substantially cylindrical bore. Each aperture may be angled perpendicular to the longitudinal axis of the male element. Each aperture may extend from an inside surface of the male element to an outside surface of the male element. Each aperture may be for receiving and at least partially or fully housing a locking element. Each aperture may comprise a portion having a slight reduction in diameter of the aperture at a radially outer region. The apertures may be circumferentially substantially equidistantly spaced apart. The apertures may be arranged in at least one or multiple rows spaced circumferentially around the connector. Each row of apertures may be circumferentially in line with the next row. Each row of apertures may be circumferentially offset from the next row.

The connector may comprise a locking member moveable from a fully unlocked position to a fully locked position. The locking member may be operative to cause the or each locking element to protrude from its aperture so that it may engage with a groove to rotatably mount the connector to a receptacle when in the fully locked position. The locking member may be operative to allow the or each locking element to disengage from a groove to release the connector from a receptacle when in the fully unlocked position. The locking member may be housed within the connector.

The connector may comprise one or more locking elements. For example, there may be at least 3, 6, 9 or 12 locking elements. The locking elements may be rolling elements such as balls, cylinders, or the like. The locking elements are preferably locking balls. The locking elements may be formed from a metal.

The attachment point may be a padeye, a hook, an eyebolt or an eye nut. The attachment point may comprise an aperture. The attachment point may be fixed relative to the remainder of the connector. Thus, the attachment point may have a fixed orientation relative to the remainder of the connector.

When the locking member is in its fully locked position, the locking member may be spaced away from the free end male element of the connector, each locking element may be positively urged radially outwards of the connector by the locking member and housed partially in its aperture such that an edge of each locking element protrudes from its aperture for mounting the connector with a receptacle.

When the locking member is in its fully unlocked position, the locking member may be near to or adjacent the free end of the male element of the connector, each locking element may float freely of the locking member and may be received and housed partially in its aperture such that no edge of the locking element is pushed to protrude from the aperture for dismounting the connector from a receptacle.

The structure may be a lifting structure. The structure may comprise a lifting frame or a lifting cage or a subsea module.

The structure may comprise a lifting frame or a lifting cage coupled to a module such as a subsea module. The subsea module may be a compressor module or a pump module. The lifting assembly may be an offshore marine lifting assembly. The structure may be an offshore marine structure. The connector may be an offshore marine connector.

According to a second aspect of the present invention there is provided a method of lifting or lowering a load comprising the steps of:

providing a lifting assembly according to the first aspect of the invention;

inserting at least two connectors into respective receptacles of the structure and arranging so that the male elements of the connectors are rotatably positioned in the receptacles in a first set of rotational positions so that the attachment points are positioned to permit connection to one or more lifting lines in a first lifting configuration;

lifting or lowering the lifting assembly using attachment lines in the first lifting configuration;

subsequently repositioning the male element of one or more of the connectors rotatably within the receptacle in which it is mounted so that the connectors are rotatably positioned in the receptacles in a second set of rotational positions so that the attachment points are positioned to permit connection to one or more lifting lines in a second lifting configuration different to the first lifting configuration; and lifting or lowering the lifting assembly using attachment lines in the second lifting configuration.

The method allows a lifting configuration to be changed, for example to accommodate a change of, or a change in the position of, a load.

The method may further comprise repositioning the male element or one or more of the connectors rotatably within the receptacle in which it is mounted so that the connectors are rotatably positioned in the receptacles in a third set of rotational positions so that the attachment points are positioned to permit connection to one or more lifting lines in a third lifting configuration different to the first lifting configuration; and lifting or lowering the lifting assembly using attachment lines in the third lifting configuration.

Four connectors may be inserted into four respective receptacles.

The first or second lifting configuration may be a single point lift where each attachment point is connected by a lifting line to a single point of lift, such as to a single lifting ring. Each attachment point may be connected to the single point of lift by a lifting line of substantially the same length.

At least one attachment point may be connected to a single point of lift by a lifting line shorter than that connecting at least one other attachment point to the single point of lift, to account for the position of the centre of mass of a load being lifted.

The first or second lifting configuration may be two a point lift where one or more attachment points are connected by a lifting line to a first point of lift and one or more other attachment points are connected by a lifting line to a second point of lift.

Other lifting configurations are possible, for example with three, four or more points of lift.

DETAILED DESCRIPTION OF THE INVENTION

In order that the invention may be more clearly understood embodiments thereof will now be described, by way of example only, with reference to the accompanying drawings, of which:

Figure 1:
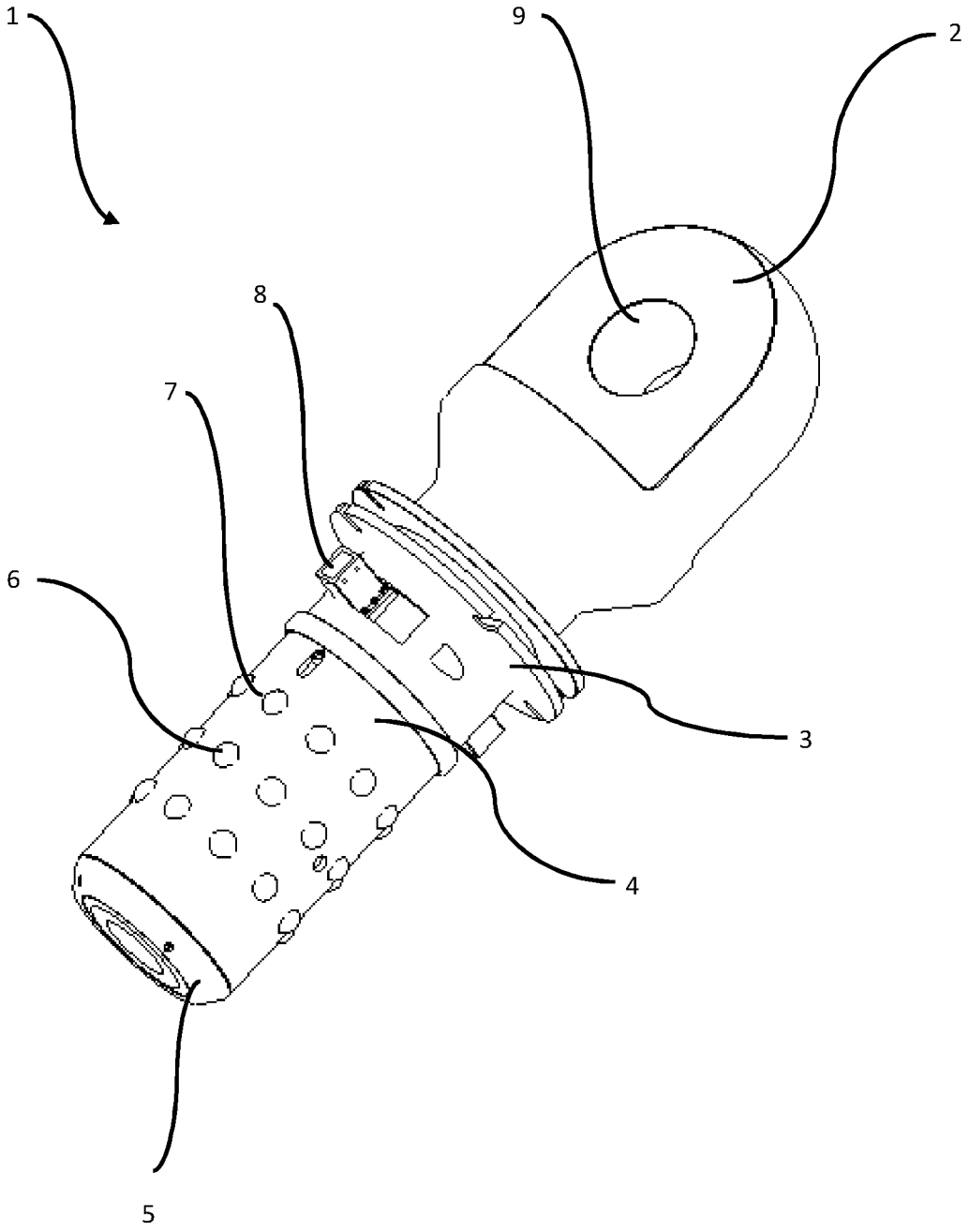
FIG. 1 is a perspective view of a connector.

Referring to FIG. 1, a connector 1 comprises an elongate substantially cylindrical male element 4 having a frustoconical free front end 5 and a fixed attachment point formed on its rear end. In this embodiment, the attachment point is a padeye 2 comprising a cylindrical aperture 9. A pair of flanges 3 is formed towards the middle of the connector 1, between the front end 5 and the padeye 2.

Extending through the wall of the male element 4 is a plurality of circumferentially substantially equidistantly spaced apertures 7. Each aperture 7 is a substantially cylindrical bore that is perpendicularly angled with respect to the major axis of the male element 4.

A locking element, in this case a spherical locking ball 6, sits within each of the apertures 7 in the male element 4. Each aperture 7 is sized and shaped so as to capture a locking ball 6 in such a way that a portion of the locking ball 6 can extend radially outward and inward from the aperture 7, but cannot fully escape from the aperture 7. This is achieved by a slight reduction in the diameter of the aperture 7 at its radially outer region. Thus, the apertures 7 allow the male element 4 to act as a cage to restrict movement of the locking balls 6.

In this embodiment, three rows of locking balls 6 and respective apertures 7 are provided, which are longitudinally substantially equidistantly spaced from one another.

The connector 1 further comprises a switch 8 that is operable to move a locking member (not shown) between a fully unlocked position and a fully locked position. When the locking member is in its fully locked position, the locking balls 6 are held radially outward by the locking member so that each locking ball 6 protrudes radially out of its aperture 7. When the locking member is in its fully unlocked position, the locking balls 6 are received into their aperture 7 so that each locking ball 6 does not protrude radially out of its aperture 7.

Figure 2:
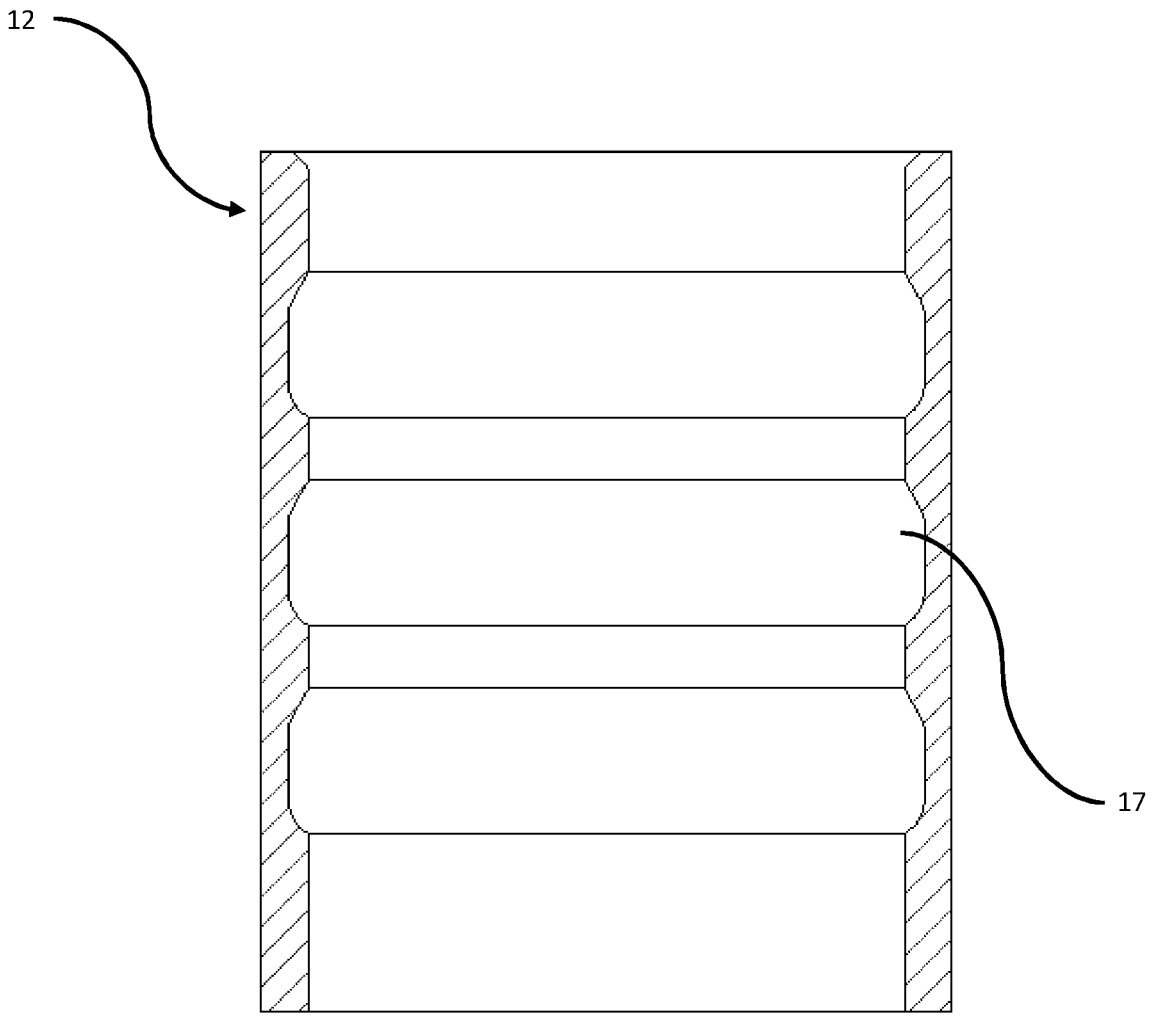
FIG. 2 is a cross-sectional view of a receptacle.
Figure 3:
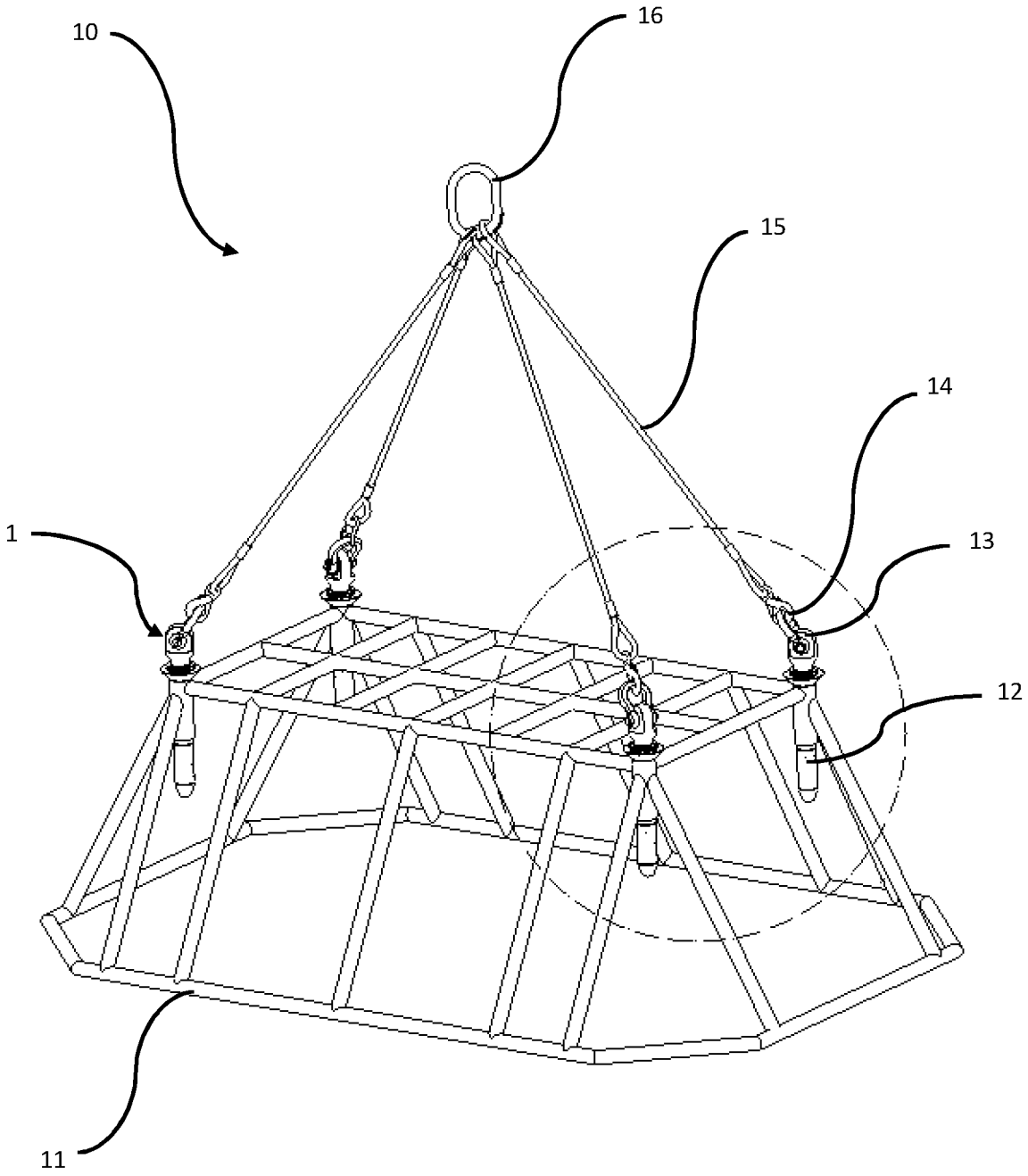
FIG. 3 is a perspective view of an assembly comprising four connectors rotatably mounted to a structure, with the connectors oriented in a first lifting configuration.
Figure 4:
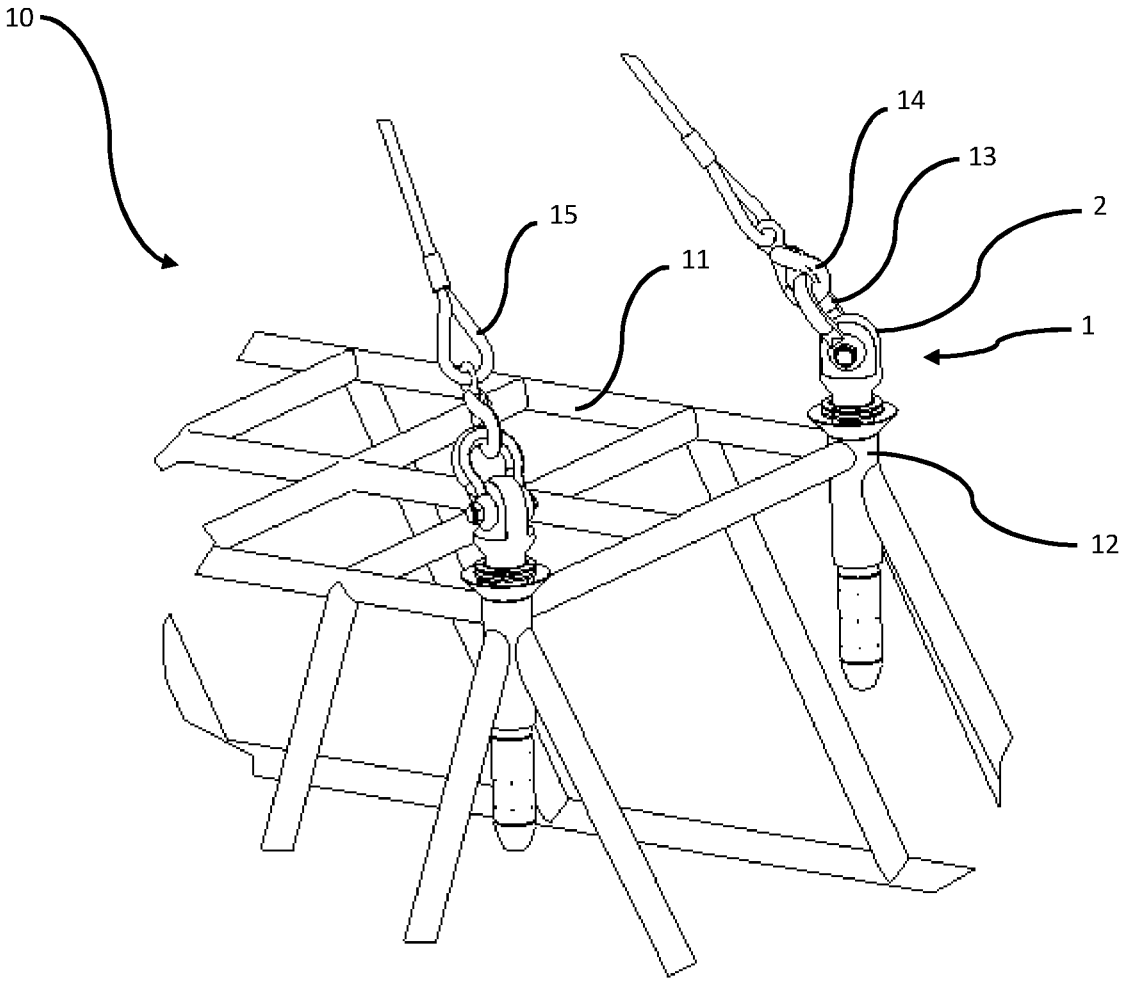
FIG. 4 is an enlarged view of part of the circled portion in FIG. 3.

Referring to FIG. 2, a receptacle 12 defines a substantially cylindrical bore with a plurality of circumferential grooves 17 in its internal surface. The grooves 17 are each spaced circumferentially substantially equidistantly from one another and extend around the whole circumference of the receptacle 12. In this embodiment, three rows of grooves 17 are provided in each receptacle 12 in order to correspond to the three rows of locking balls 6 provided on the connector 1.

Referring to FIGS. 3, 4 and 5A-C, a lifting assembly 10 comprises four connectors 1 rotatably mounted to a structure 11, such as a lifting cage. Each connector 1 is the same as is described above and may rotate relative to the structure about the major axis of the male element of the connector.

The structure 11 comprises four substantially cylindrical receptacles 12 arranged in a rectangular configuration with their long axes substantially parallel to each other. Each receptacle 12 is fixed in position relative to the reminder of the structure 11 and the same as is described above.

A shackle 13 is coupled to the aperture 9 of each padeye 2. Each shackle 13 is in turn coupled to a clip 14, which is coupled to a lifting cable 15. Each lifting cable 15 is coupled to a lifting ring 16, which acts as a lifting point to allow the assembly 10 to be lifted by a suitable machine such as a crane. In this embodiment, each lifting cable 15 is coupled to the same lifting ring 16 and consequently there is a single lifting point.

In use, a connector 1 is fully inserted into each receptacle 12 provided on a structure 11 to be lifted. When a connector has reached its fully inserted position, its switch 8 is activated. This moves the connector's locking member from its fully unlocked position to its fully locked position, which forces the locking balls 6 to move to their fully locked position where they protrude out of their respective apertures 7. In this fully locked position, each of the three rows of locking balls 6 engage with a circumferential groove 17 formed in the receptacle 12 in order to mount the connector 1 to the receptacle 12. The connector 1 cannot now be removed from the receptacle 12 without operating its switch 8 to move the locking member and the locking balls 6 to their unlocked positions, but can be rotated about its longitudinal axis relative to the receptacles 12 and therefore the structure 11. Thus, the padeye 2 attached to the connector 1 is also rotatably mounted to the structure 11. In some embodiments the connector may 1 be, in practice, inhibited from rotating in the receptacle when a load is applied to the connector and/or the act of locking the connector to the receptacle may prevent it rotating in the receptacle. What is important is that the connector may be positioned in the receptacle with a desired rotational alignment relative to the structure.

A shackle 13 is coupled to the aperture 9 of each padeye 2, a clip 14 is attached to each shackle 13 and a lifting cable 15 is attached to each clip 14. Each lifting cable 15 is then attached to the same lifting ring 16.

The hook of a crane or a hoist is then engaged with the lifting ring 16 to begin the lifting operation. In this embodiment, the structure 11 is lifted by using a single point lift.

During this lifting operation, as the lifting ring 16 is raised whilst the structure 11 is still grounded, the lifting cables 15 are put under tension. This tension causes a turning force, which rotates the padeyes 2 until they are in an orientation where there is no turning force applied and thus no adverse bending moment acting on the padeyes 2. This orientation is when the aperture 9 of each padeye 2 is substantially perpendicular to the lifting point. This orientation also corresponds to a maximum strength orientation, in which each padeye 2 can be used to lift its maximum load.

Specifically, as a padeye 2 is urged to rotate into its maximum strength orientation by the tension in the connected lifting line 15, the locking balls 6 of the connector 1 on which the padeye 2 is provided travel around the surface of their engaged circumferential groove 17 in the receptacle 12 that the connector 1 is locked to, allowing the connector 1, and thus the padeye 2, to rotate relative to the structure 11.

In other embodiments the connectors become rotationally fixed in the receptacles or are insufficiently free to rotate so that they will rotationally self-align when a load is applied. In this case the connectors should be arranged in the desired relative rotational orientations before lifting or lowering commences.

Figure 5A:
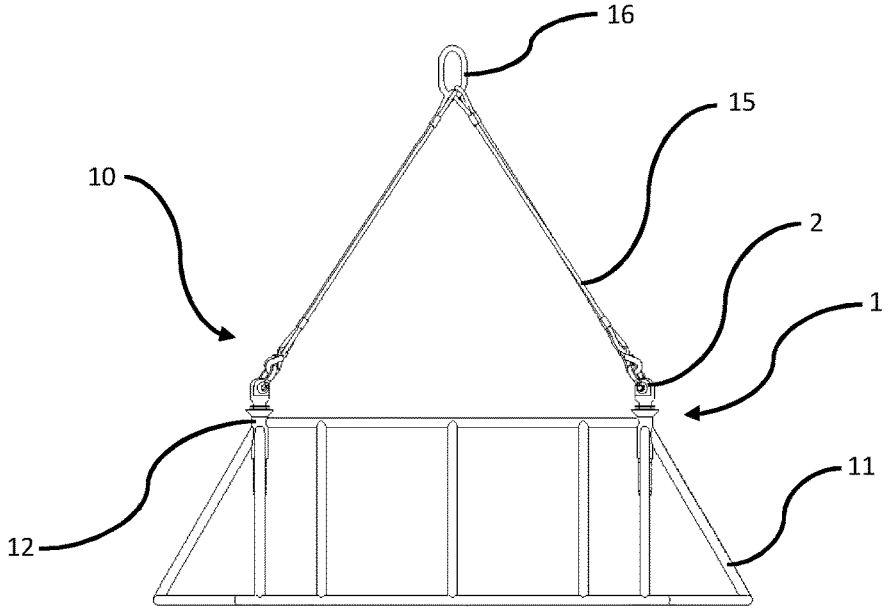
FIG. 5A is a side view of the assembly shown in FIG. 3.
Figure 5B:
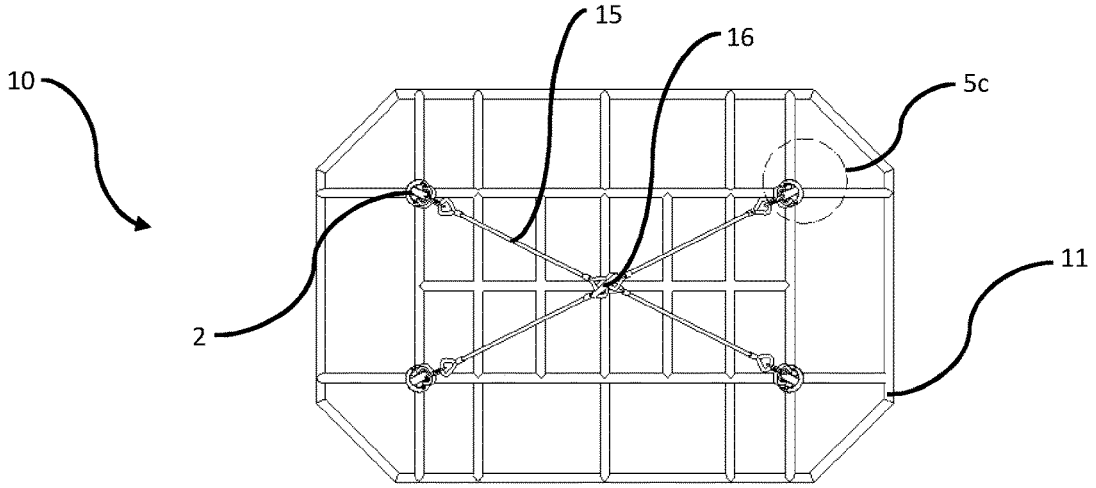
FIG. 5B is a plan view of the assembly shown in FIG. 5A.
Figure 5C:
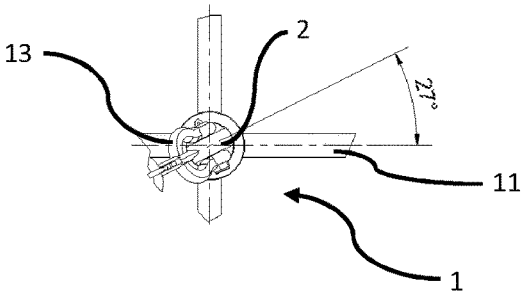
FIG. 5C is an enlarged view of the circled portion in FIG. 5B.

The ability for the connectors to rotate and/or be positioned in desired relative rotational positions permits different lifting configurations to be employed with the same structure. For example, FIGS. 5A-C show an assembly 10 comprising four connectors 1 rotatably mounted to a structure 11 in a rectangular arrangement. One lifting point is used and four lifting lines 15 of the same length are connected to the lifting ring 16. The maximum strength orientation of each padeye 2 in this first lifting configuration is thus when the padeye is at an angle of approximately 30° relative to the structure 11. If any of the padeyes 2 are not oriented at this angle when tension is applied to each lifting line 15 during the lifting operation then they will rotate (if sufficiently free to do so) until they reach their maximum strength orientation in the manner described above.

Although FIGS. 3, 4 and 5A-C show a lifting assembly 10 that has a first lifting configuration in which there is a single lifting ring 16 and four lifting lines 15, many different padeye 2 orientations are possible depending on the lifting requirements, such as the need to ensure that the centre of mass of the load is under the lifting ring 16.

Figure 6A:
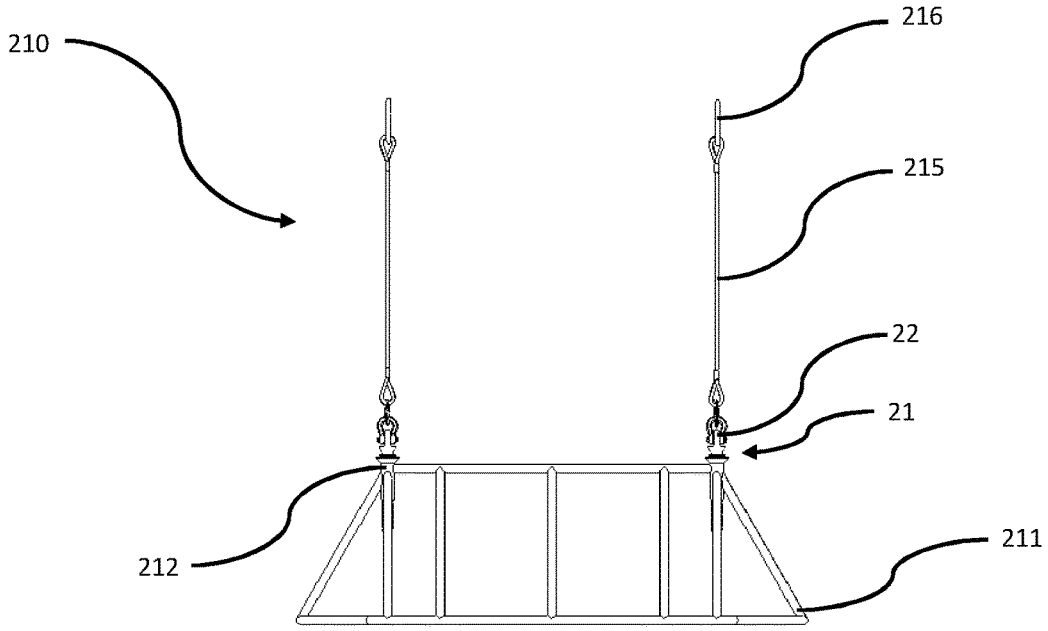
FIG. 6A is a side view of an assembly comprising four connectors rotatably mounted to a structure, with the connectors oriented in a second lifting configuration.
Figure 6B:
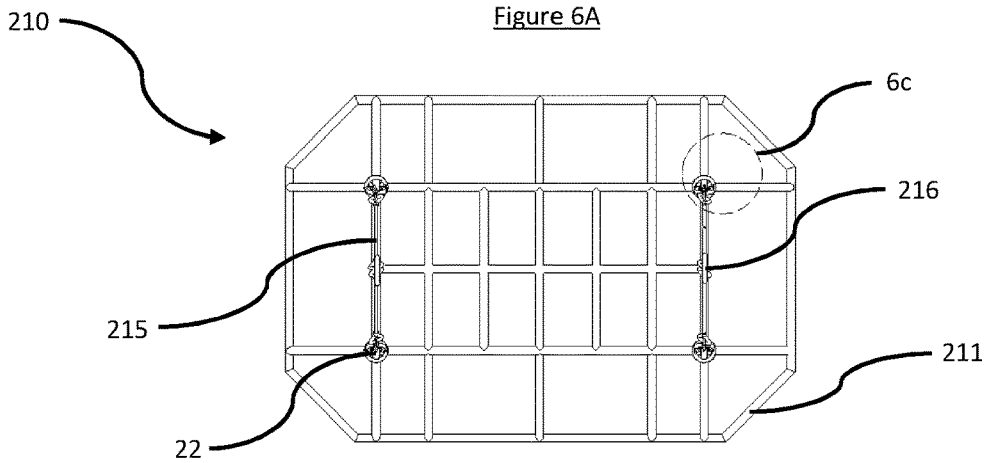
FIG. 6B is a plan view of the assembly shown in FIG. 6A.
Figure 6C:
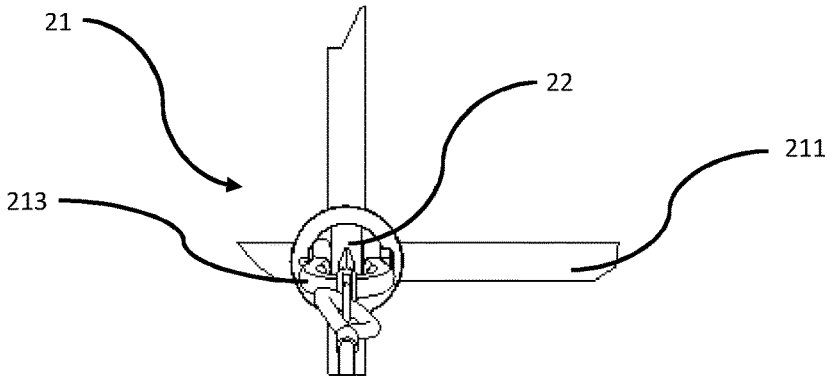
FIG. 6C is an enlarged view of the circled portion in FIG. 6B.
Figure 7A:
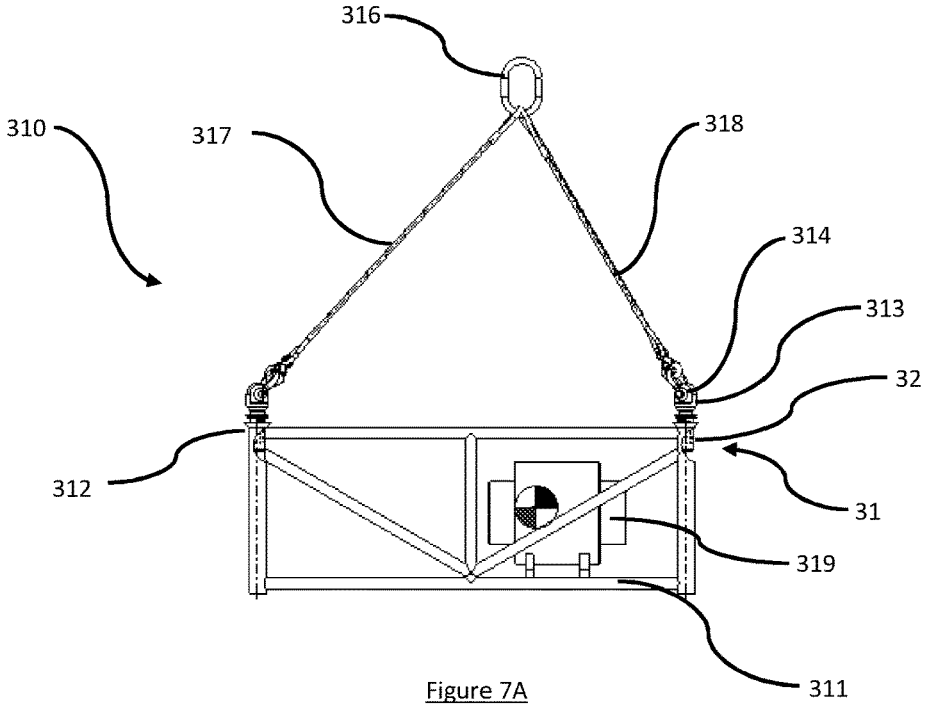
FIG. 7A is a side view of an assembly comprising four connectors rotatably mounted to a structure, with the connectors oriented in a third lifting configuration.
Figure 7B:
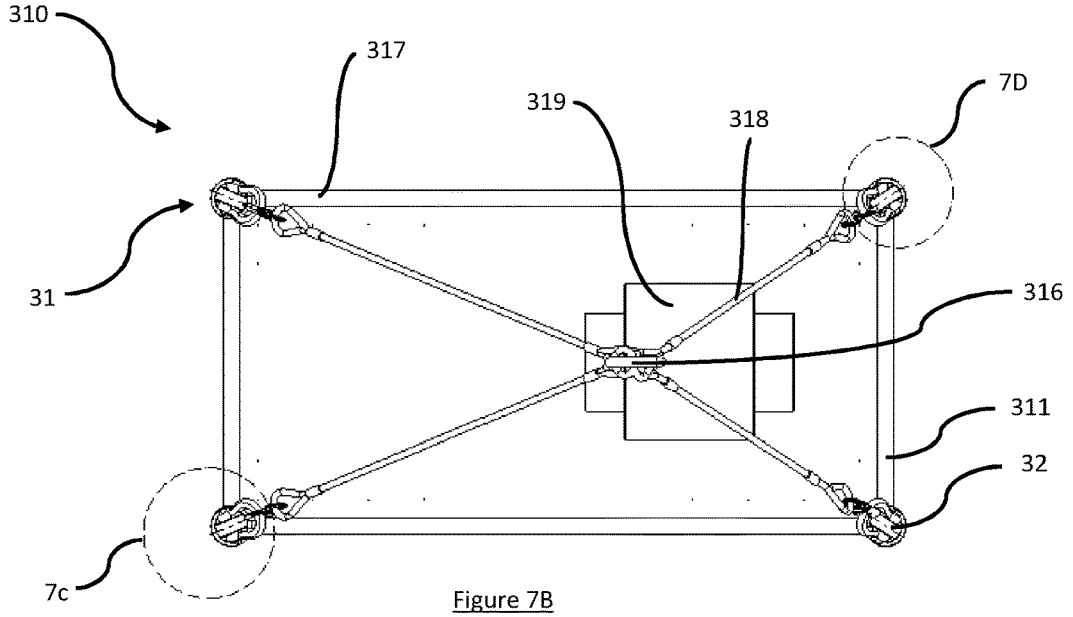
FIG. 7B is a plan view of the assembly shown in FIG. 7A.
Figure 7C:
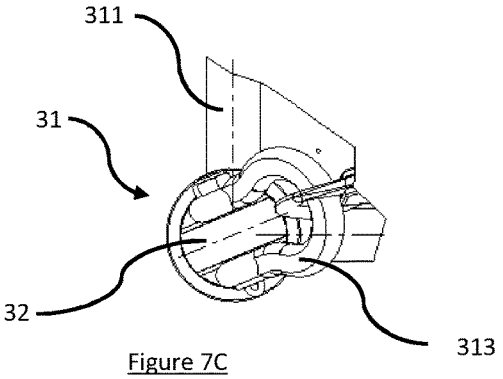
FIG. 7C is an enlarged view of a circled portion in FIG. 7B.
Figure 7D:
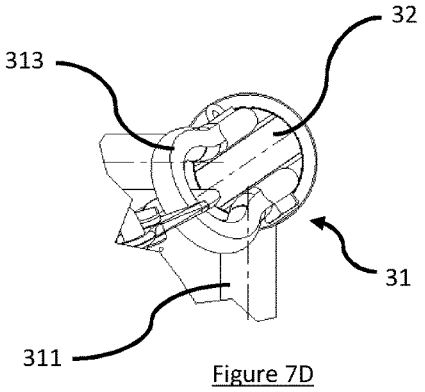
FIG. 7D is an enlarged view of a circled portion in FIG. 7B.

FIGS. 6A-C show a lifting assembly 20 having the same structural features as the lifting assembly 10 shown in FIGS. 3, 4 and 5A-C. However the lifting assembly shown in FIGS. 6A-C has a second, different, lifting configuration in which two lifting rings 216 are used and two lifting lines 215 of the same length are connected to each lifting ring 216. The maximum strength orientation of each padeye 22 in this second lifting configuration is when the padeye 22 is at an angle of approximately 90° relative to the structure 211. If any of the padeyes 22 are not at this angle when tension is applied to each lifting line 215 during the lifting operation then they will rotate until they reach their maximum strength orientation in the manner described above.

FIGS. 7A-D show a lifting assembly 30 that has a third lifting configuration in which one lifting ring 316 is used and four lifting lines 315 are connected to the lifting ring 316. This arrangement differs from the arrangement shown in FIGS. 5A-C because there are two short lifting lines 318 and two long lifting lines 317 connected to the lifting ring 316 in order to compensate for a non-centrally placed load 319 carried by the structure 311. In addition, the receptacles 312 are integrated into the structure 311. The maximum strength orientation of the each padeye 32 connected to the short lifting lines 318 is approximately 34° relative to the structure 311. The maximum strength orientation of the each padeye 32 connected to the long lifting lines 317 is approximately 23° relative to the structure 311. If any of the padeyes 32 are not at these angles when tension is applied to each lifting line 215 during the lifting operation then they will rotate (if sufficiently free to do so) until they reach their maximum strength orientation in the manner described above.

With this arrangement, the present invention provides an assembly 10 in which padeyes 2 are rotatably mounted to a structure 11. This allows the padeyes 2 to rotate relative to the structure 11 into an orientation in which they can provide their maximum strength when the structure 11 is lifted via lifting lines 15 attached to two or more padeyes 2, or to be positioned into desired relative rotational positions prior to lifting. This improves functionality and safety since the multiple lifting configurations can be used each with the padeyes 2 oriented correctly so that they are less likely to experience an adverse bending moment and fail when the structure 11 is lifted.

In contrast, conventional structures, such as lifting cages, comprise padeyes welded to them in a fixed orientation relative to the structure. Accordingly, if a different lifting configuration is required then either a different structure with differently oriented fixed padeyes is used, which is time-consuming, or the same structure is used but with the padeyes not at their maximum strength orientation and experiencing an adverse bending moment, which may be dangerous.

The above embodiments are described by way of example only. Many variations are possible without departing from the scope of the invention as defined in the appended claims.

For example, the attachment points may not be padeyes, but may be any type of attachment point. In particular, the attachment points may be any type of attachment point that has a maximum strength when in a specific orientation.

Furthermore, although in the above embodiments each padeye (or attachment point) can rotate to its maximum strength orientation due to tension in the attached lifting line, the padeye or attachment point may alternatively or additionally be rotated manually by an operator to a desired rotational position or connector initially inserted in the receptacle in a desired rotational position.

The invention claimed is:

1. A lifting assembly comprising:

a lifting frame or a lifting cage connected to, or forming part of, or for, lifting apparatus deployed, or intended to be deployed, in a subsea location, the lifting frame or the lifting cage comprising four or more receptacles, each receptacle comprising one or more circumferential grooves in its inside surface; and at least four connectors, each connector comprising a male element for insertion into a receptacle of the lifting frame or the lifting cage, an attachment point for coupling to a lifting line, and one or more locking elements provided on the outside surface of the male element, wherein the one or more locking elements are engageable with the or each groove in the inside surface of a receptacle to enable the male element to be mounted in the receptacle at any desired rotational position relative to the receptacle and thereby mount the attachment point to the lifting frame or lifting cage.

2. A lifting assembly according to claim 1 wherein the male element of each connector is rotatably mountable in a receptacle of the lifting frame or the lifting cage.

3. A lifting assembly according to claim 1, wherein the one or more locking elements are engageable with a groove in the inside surface of the receptacle so as to removably mount the attachment point to the lifting frame or the lifting cage.

4. A lifting assembly according to claim 1 comprising the same number of connectors as receptacles.

5. A lifting assembly according to claim 1, wherein each receptacle comprises a plurality of grooves in its inside surface.

6. A lifting assembly according to claim 5, wherein the grooves are spaced from one another with respect to a longitudinal axis of the receptacle.

7. A lifting assembly according to claim 1, wherein the locking elements are rolling elements.

8. A lifting assembly according to claim 7, wherein the locking elements are locking balls.

9. A lifting assembly according to claim 1, wherein the attachment point is fixed relative to the remainder of the connector.

10. A method of lifting or lowering a load comprising the steps of:

providing a lifting assembly according to claim 1, wherein the attachment points comprise padeyes;

inserting at least four connectors into respective receptacles of the structure lifting frame or the lifting cage and arranging so that the male elements of the connectors are rotatably positioned in the receptacles in a first set of rotational positions so that the padeyes are positioned to permit connection to one or more lifting lines in a first lifting configuration;

lifting or lowering the lifting assembly using the or each lifting line in the first lifting configuration;

subsequently repositioning the male element of one or more of the connectors rotatably within the receptacle in which it is mounted so that the connectors are rotatably positioned in the receptacles in a second set of rotational positions so that the padeyes are positioned to permit connection to one or more lifting lines in a second lifting configuration different to the first lifting configuration; and lifting or lowering the lifting assembly using the or each lifting line in the second lifting configuration.

11. A method according to claim 10 comprising repositioning the male element of one or more of the connectors rotatably within the receptacle in which it is mounted so that the connectors are rotatably positioned in the receptacles in a third set of rotational positions so that the padeyes are positioned to permit connection to one or more lifting lines in a third lifting configuration different to the first lifting configuration; and lifting or lowering the lifting assembly using the or each lifting line in the third lifting configuration.

12. A method according to claim 10 wherein four connectors are inserted into four respective receptacles.

13. A method according to claim 10 wherein the first and/or second lifting configuration is a single point lift where each padeye is connected by a lifting line to a single point of lift.

14. A method according to claim 13 wherein each padeye is connected to the single point of lift by a lifting line of substantially the same length.

15. A method according to claim 13 wherein at least one padeye is connected to the single point of lift by a lifting line shorter than that connecting at least one other padeye to the single point of lift, to account for the position of the centre of mass of a load being lifted.

16. A method according to claim 10 wherein the first or second lifting configuration is a two point lift where one or more padeyes are connected by a lifting line to a first point of lift and one or more other padeyes are connected by a lifting line to a second point of lift.

17. A method according to claim 10 wherein one lifting configuration is a three or four point lift.

18. A lifting assembly according to claim 1 wherein the four or more receptacles are located at a top of the lifting frame or lifting cage.

19. A lifting assembly according to claim 1 wherein each receptacle is fixed relative to the lifting frame or lifting cage.

20. A lifting assembly comprising:

a lifting frame or a lifting cage connected to, or forming part of, or for, lifting apparatus deployed, or intended to be deployed, in a subsea location, the lifting frame or the lifting cage comprising four or more receptacles at a top of the lifting frame or the lifting cage, each receptacle comprising one or more circumferential grooves in its inside surface and being fixed relative to the lifting frame or lifting cage; and at least four connectors, each connector comprising a male element for insertion into a receptacle of the lifting frame or the lifting cage, a padeye for coupling to a lifting line, and one or more locking elements provided on the outside surface of the male element, wherein the one or more locking elements are engageable with the or each groove in the inside surface of a receptacle of the four or more receptacles to enable the male element to be mounted in the receptacle at any desired rotational position relative to the receptacle and thereby mount the padeye to the lifting frame or lifting cage.

* * * * *